US006789690B2

(12) United States Patent
Nieh et al.

(10) Patent No.: US 6,789,690 B2
(45) Date of Patent: Sep. 14, 2004

(54) HOSE DIRECT CANISTER LID

(75) Inventors: Luther T. Nieh, Redwood City, CA (US); Michael H. Tsao, S. San Francisco, CA (US); Djabbar Moustafaev, Watsonville, CA (US); Landen M. Higer, San Francisco, CA (US)

(73) Assignee: Tilia International, Inc., San Francisco, CA (US)

( * ) Notice: Subject to any disclaimer, the term of this patent is extended or adjusted under 35 U.S.C. 154(b) by 0 days.

(21) Appl. No.: 10/174,267

(22) Filed: Jun. 18, 2002

(65) Prior Publication Data

US 2003/0197011 A1 Oct. 23, 2003

Related U.S. Application Data

(60) Provisional application No. 60/374,085, filed on Apr. 19, 2002.

(51) Int. Cl.[7] ..... B65D 51/16

(52) U.S. Cl. ..... 220/231; 220/367.1; 220/378; 220/203.11; 220/212; 215/262; 215/260; 215/228

(58) Field of Search ..... 220/203.02, 203.11, 220/203.24, 231, 203.23, 212, 203.28, 240, 367.1, 378; 215/262, 270, 260, 228, 315; 99/472

(56) References Cited

U.S. PATENT DOCUMENTS

| | | | | |
|---|---|---|---|---|
| 1,346,435 A | | 7/1920 | Worster | |
| 1,521,203 A | | 12/1924 | Roehrig | |
| 2,270,332 A | | 1/1942 | Osborn, Jr. | 137/53 |
| 2,270,469 A | | 1/1942 | Osborn, Jr. | 137/53 |
| 2,406,771 A | | 9/1946 | Hughes | 226/82 |
| 2,416,900 A | | 3/1947 | Busby | 215/56 |
| 2,436,849 A | | 3/1948 | Billetter | 226/82 |
| 2,506,362 A | | 5/1950 | Hofmann | 220/24 |
| 2,755,952 A | | 7/1956 | Ringen | 215/52 |
| 2,890,810 A | | 6/1959 | Rohling | 220/24 |
| 2,966,276 A | | 12/1960 | Hing | 215/52 |
| 3,055,536 A | | 9/1962 | Dieny | 220/44 |
| 3,167,202 A | | 1/1965 | Tolciss | 215/47 |
| 3,320,097 A | | 5/1967 | Sugalski | 136/178 |
| 3,827,596 A | | 8/1974 | Powers, Jr. | 220/44 |
| 3,858,750 A | | 1/1975 | Grall | 220/203 |
| 3,924,774 A | | 12/1975 | Donnelly | 220/93 |
| 4,016,999 A | | 4/1977 | Denzer | 220/231 |
| 4,051,971 A | | 10/1977 | Saleri et al. | 215/260 |
| 4,059,113 A | * | 11/1977 | Beinsen et al. | 53/428 |
| 4,143,787 A | | 3/1979 | Walker | 220/203 |
| 4,149,650 A | | 4/1979 | Whelchel et al. | 220/201 |
| 4,222,276 A | | 9/1980 | DeRogatis | 73/714 |

(List continued on next page.)

OTHER PUBLICATIONS

U.S. patent application Ser. No. 10/081,382, Curt L. Anderson, filed Feb. 23, 2002.

*Primary Examiner*—Lee Young
*Assistant Examiner*—James Smalley
(74) *Attorney, Agent, or Firm*—Fliesler Meyer LLP

(57) ABSTRACT

A hose direct cannister lid includes a port that accepts a hose connected to a source of vacuum in order to evacuate a cannister to which the lid is connected. The hose direct cannister lid includes a first valve for exposing the cannister to the source of vacuum when the vacuum hose is secured to the lid, and wherein the first valve closes when the source of vacuum is removed in order to seal the lid and cannister from ambient. The hose direct cannister includes a second valve used to break the vacuum and expose the interior of the cannister to ambient.

19 Claims, 4 Drawing Sheets

U.S. PATENT DOCUMENTS

| | | | | |
|---|---|---|---|---|
| 4,249,583 | A | 2/1981 | Lundbladh | 141/65 |
| 4,278,114 | A | 7/1981 | Ruberg | 141/65 |
| 4,349,118 | A | 9/1982 | Sanderson | 220/201 |
| 4,372,096 | A | 2/1983 | Baum | 53/88 |
| 4,442,951 | A | 4/1984 | Nakazawa et al. | 220/319 |
| 4,625,887 | A | 12/1986 | Ito | 220/231 |
| 4,660,355 | A | 4/1987 | Kristen | 53/510 |
| D296,108 | S | 6/1988 | Niedworok | D15/146 |
| 4,909,014 | A | 3/1990 | Kobayashi et al. | 53/86 |
| 4,989,745 | A | 2/1991 | Schneider | 220/208 |
| 5,031,785 | A | 7/1991 | Lemme | 215/228 |
| 5,121,590 | A | 6/1992 | Scanlan | 53/510 |
| 5,195,427 | A | 3/1993 | Germano | 99/472 |
| 5,203,465 | A | 4/1993 | Baumgarten | 220/206 |
| 5,232,016 | A | 8/1993 | Chun | 137/565 |
| 5,347,918 | A | 9/1994 | Chen | 99/472 |
| 5,364,241 | A | 11/1994 | Schultz | 417/442 |
| 5,390,809 | A | 2/1995 | Lin | 220/212 |
| 5,405,038 | A | 4/1995 | Chuang | 220/231 |
| 5,406,992 | A | 4/1995 | Miramon | 141/65 |
| 5,439,724 | A | 8/1995 | Rojek | 428/66.3 |
| 5,449,079 | A | 9/1995 | Yang | 215/228 |
| 5,465,857 | A | 11/1995 | Yang | 215/228 |
| 5,481,852 | A | 1/1996 | Mitchell | 53/432 |
| 5,499,735 | A | 3/1996 | Chen | 220/231 |
| 5,535,900 | A | 7/1996 | Huang | 215/228 |
| 5,542,583 | A | 8/1996 | Boyer et al. | 222/425 |
| 5,546,997 | A | 8/1996 | Miramon | 145/65 |
| 5,558,243 | A | 9/1996 | Chu | 220/212 |
| 5,564,480 | A | 10/1996 | Chen | 141/65 |
| 5,564,581 | A | 10/1996 | Lin | 215/228 |
| 5,597,086 | A | 1/1997 | King-Shui | 220/421 |
| 5,611,376 | A | 3/1997 | Chuang | 141/65 |
| 5,617,893 | A | 4/1997 | Webster | 137/526 |
| 5,638,971 | A | 6/1997 | Justesen | 215/228 |
| 5,651,470 | A | 7/1997 | Wu | 220/212 |
| 5,692,632 | A | 12/1997 | Hsieh et al. | 215/212 |
| 5,697,510 | A | 12/1997 | Wang et al. | 215/262 |
| 5,735,317 | A | 4/1998 | Wu | 141/65 |
| 5,765,608 | A | 6/1998 | Kristen | 141/198 |
| D395,984 | S | 7/1998 | Yang | D7/591 |
| 5,779,082 | A | 7/1998 | Miramon | 220/212 |
| 5,803,282 | A | 9/1998 | Chen et al. | 215/228 |
| 5,806,575 | A | 9/1998 | Tsay | 141/65 |
| 5,806,704 | A | 9/1998 | Jamison | 220/212 |
| 5,941,391 | A | 8/1999 | Jury | 206/524.8 |
| 5,944,211 | A | 8/1999 | Woodnorth et al. | 220/203.13 |
| 5,960,837 | A | 10/1999 | Cude | 141/65 |
| 5,971,180 | A | 10/1999 | Wu | 215/228 |
| 5,974,686 | A | 11/1999 | Nomura et al. | 34/263 |
| 5,979,688 | A | 11/1999 | Stodd | 220/231 |
| 6,035,769 | A | 3/2000 | Nomura et al. | 99/472 |
| 6,044,756 | A | 4/2000 | Chang | 99/472 |
| 6,045,011 | A | 4/2000 | Yang | 222/401 |
| 6,131,753 | A | 10/2000 | Lynch | 215/228 |
| 6,148,875 | A | 11/2000 | Breen | 141/65 |
| 6,161,716 | A | 12/2000 | Oberhofer et al. | 220/203.04 |
| 6,206,220 | B1 | 3/2001 | Stodd | 220/231 |
| 6,253,947 | B1 | 7/2001 | Yang | 220/324 |
| 6,375,024 | B1 | 4/2002 | Park | 215/262 |
| 6,619,493 | B2 * | 9/2003 | Yang | 215/228 |
| 2001/0023572 | A1 | 9/2001 | Savage et al. | |

* cited by examiner

HOSE DIRECT CANISTER LID

CLAIM OF PRIORITY

This application claims priority from provisional application entitled "HOSE DIRECT CANISTER LID," Application No. 60/374,085, filed Apr. 19, 2002 under 35 U.S.C. §119 (e), which application is incorporated herein by reference.

FIELD OF THE PRESENT INVENTION

The present invention generally relates to a canister lid that can form an airtight seal with a canister body so that a vacuum can be created within the canister body.

BACKGROUND OF THE INVENTION

Food products, whether liquid or dry, spoil fairly quickly and can emit odors. Lids and storage devices have been developed for use with food storage containers that seal outside air from the goods stored within the container.

Vacuum sealing of perishables in the home and kitchen is becoming more popular as people increasingly become aware of the health benefits of the natural and healthy foods. Such foods, that do not contain preservatives, lose their freshness quickly. Storing foods in a vacuum sealed canister is a non-chemical way to help preserve the freshness of the food. Vacuum packing has the added benefit of evacuating the air from within the container as well as sealing off the outside air. Such packing increases storage life and eliminates odors. A simple, easy-to-use system for household use that allows goods to be vacuum packed would be advantageous.

Most available vacuum sealers are not particularly well suited for home use with rigid containers because they rely on hand pumps to pull a vacuum, or there must be an adapter that connects a vacuum hose to the canister lid. Accordingly, it would be advantageous if the vacuum hose could directly engage and mate with the canister lid to create a vacuum within the canister.

SUMMARY OF SOME OF THE ASPECTS OF PRESENT INVENTION

The present invention addresses the disadvantages of the prior art. One aspect of the present invention is to provide a canister lid that can form a seal with the canister body so that a vacuum may be created and maintained within the canister body. An embodiment of the present invention is a canister lid that includes a vacuum port that can directly couple to and seal with a vacuum hose. Accordingly, an external vacuum hose can be inserted into the port in order to create a vacuum, without the need for any adapting mechanism. The canister lid also includes an exhaust valve for releasing the vacuum.

In another embodiment of the present invention a separate vacuum valve and exhaust valve are used to restrict and direct the air flow into and out of the canister body.

An embodiment of the present invention includes a vacuum port located on the top of the canister, said vacuum port has a shape that compliments the shape of a vacuum hose fitting.

Still another aspect of the present invention is to provide a canister lid that prevents liquid within the canister body from traveling through the vacuum valve or the exhaust valve.

Yet another aspect of the present invention, as indicated above, is to provide a canister lid that includes an exhaust valve. The exhaust valve releases the vacuum created within the canister body without having to remove the canister lid from the canister body. In one embodiment of the present invention, the canister lid includes a release button that can break the seal between the canister lid and the canister itself.

In another aspect of the invention, the lid includes a gasket for the effective sealing of a canister.

Other objects, aspects, and advantages of the invention are evident from are view of the figures, the claims and below descriptions of embodiments of the invention.

BRIEF DESCRIPTION OF THE DRAWINGS

FIG. 3A is a cut-away view of the embodiment of the housing of the invention of FIG. 1; FIG. 3B is a top view of the housing shown in FIG. 3A. FIG. 3C is an alternate embodiment of the housing of the invention depicted in FIG. 3B.

FIG. 3D is an enlarged section view of an embodiment of the gasket of the invention.

DETAILED DESCRIPTION OF THE PRESENT INVENTION

Figure 1:
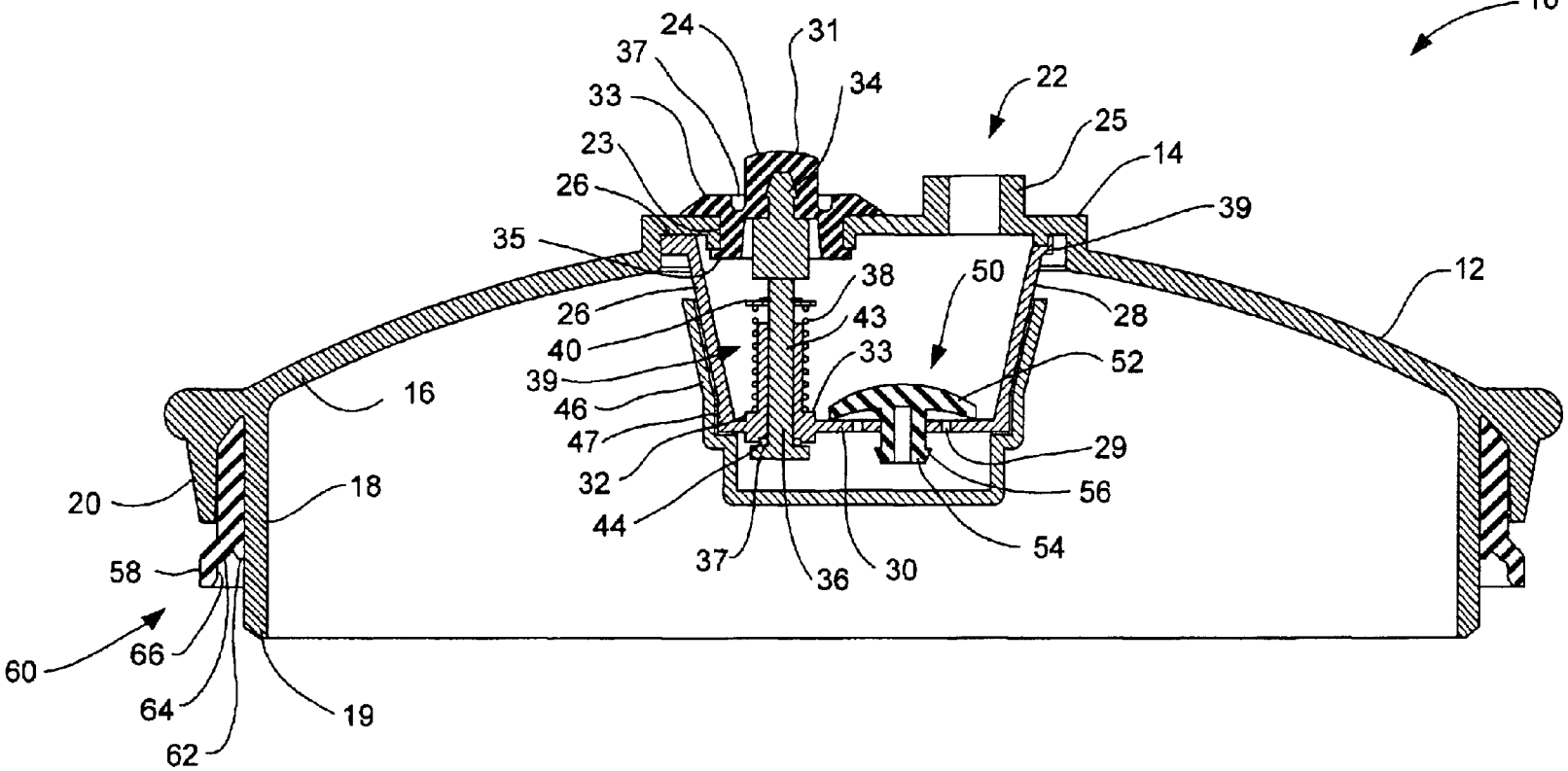
FIG. 1 is a side cut-away view of an embodiment of the present invention.
Figure 2:
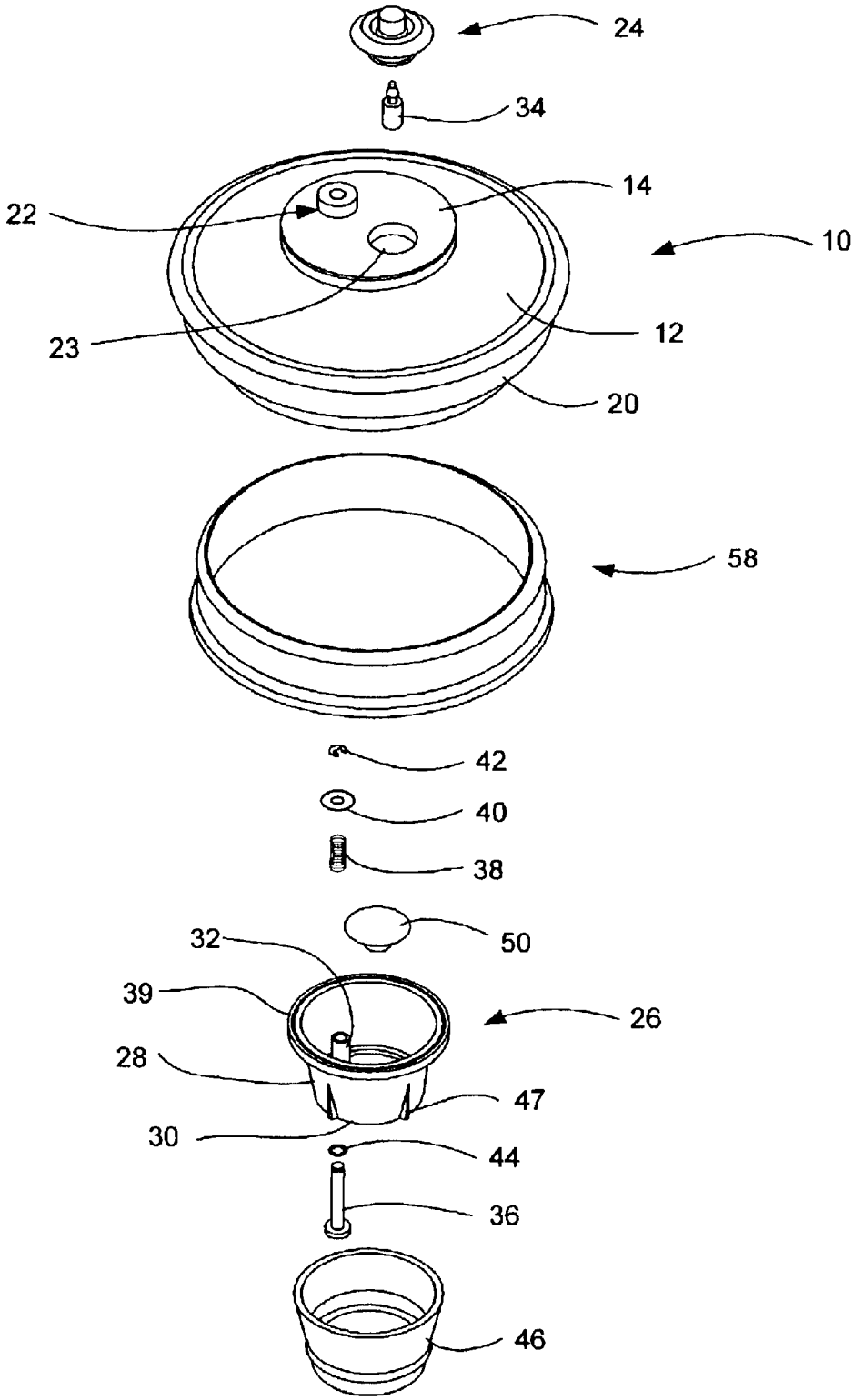
FIG. 2 is an exploded view of the embodiment shown in FIG. 1.

FIGS. 1–2 illustrate an embodiment of the canister lid 10. In general, the canister lid 10 has a circular configuration when viewed from the top, although other shapes are within the spirit and scope of the invention. The canister lid 10 can be comprised of plastic materials as is known in the industry. The canister lid 10 in a preferred embodiment has a smooth continuous convex or dome-shaped top surface 12 with a flat, raised portion 14 located in the center of the lid 10. The top of the lid 10 preferably has a uniform thickness. Thus, the interior surface 16 of the lid 10 has a concave shape. The raised portion 14, when located at the center of the lid 10, is at the highest point of the lid 10. However, the raised portion 14 does not have to be located in the center of the top surface 12.

The raised portion 14 is shown as a circular plateau in FIGS. 1–2. The raised portion 14 can also have other configurations such as, but not limited to, square and rectangular. The raised portion 14 includes two holes that extend therethrough, which include a vacuum port 22 and a release button support hole 23. The function of the vacuum port 22 and the release button support hole 23 are described as follows.

Protruding from the top of the raised portion 14 is the collar 25 of the vacuum port 22. The collar 25 preferably has a circular cross-section and a tapered inside diameter that is substantially similar to a tapered outside diameter of a vacuum hose fitting (not shown) for home use. Accordingly, the vacuum hose with its fitting can form an airtight seal with the vacuum port 22 when the vacuum hose is engaged with the vacuum port 22. Such a seal provides for efficient removal of air from within the canister body (e.g., substantially no air leak between the vacuum hose and the collar 25). The vacuum port 22 extends through the top surface 12 and bottom surface 16 of the lid 10. The vacuum port 22 provides a single air passageway for air to travel into, or out of, the canister body while the canister lid 10 is secured to the canister body.

Located adjacent to the vacuum port 22 is the release button support hole 23. The diameter of the hole 23 is substantially equal to the diameter of the release button side wall 35. The vacuum release button 24 is preferably manufactured from a single piece of flexible material. The release button 24 includes a push button 31, a collar 33, and the side wall 35.

As shown in FIG. 1, the vacuum release button 24 is inserted into and supported by the vacuum release button hole 23. Once inserted into the vacuum release button hole 23, the side walls 35 and the collar 33 form an airtight seal with the lid 10. The collar 33 has a diameter larger than the diameter of the vacuum release button hole 23 to ensure that the collar 33 overlaps the hole 23 and that the collar 33 contacts the top surface 12 of the lid 10 surrounding the hole 23. Located between the push button 31 and the collar 33 is a trough 37. The trough 37 provides a gap between the push button 31 and the collar 33 so that when the push button 31 is depressed, or the bush button 31 is moved side to side, the seal formed between the side wall 35 or the collar 33 and the lid 10 is not broken.

A housing 26 is secured to the interior surface 16 of the lid 10. In a preferred embodiment, the housing 26 is ultrasonically welded to the interior surface 16 of the lid 10. It is within the scope and spirit of the invention to secure the housing 26 to the interior surface 16 of the lid 10 by other means. The top rim 39 (FIG. 3A) of the housing 26 is preferably flush against the interior surface 16 of the raised portion 14. In general, it is important for the housing 26 and the lid 10 to form an airtight seal. This promotes air flowing into or out of the canister body only through the interior of the housing 26 and the vacuum port 22 when the lid 10 is firmly secured onto the container body.

Figure 3A:
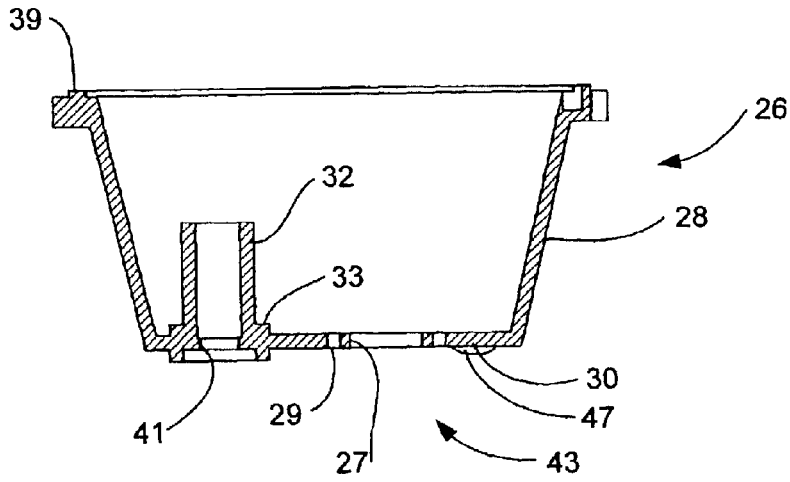
FIGS. 3A–3D.
Figure 3B:
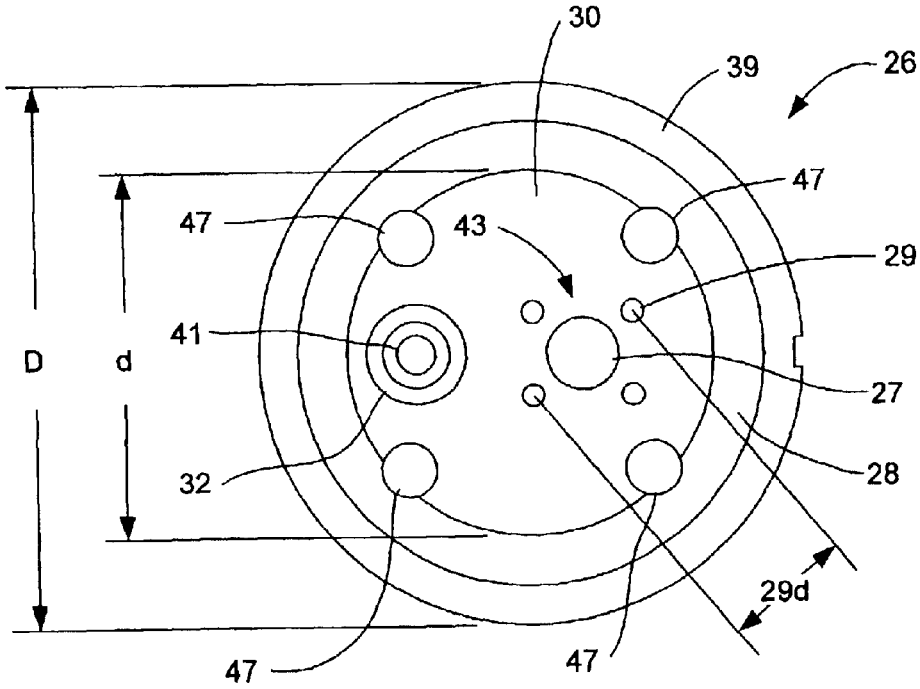

FIGS. 3A–3B illustrate more detail of the housing 26. The housing 26 is preferably manufactured from a single piece of material, preferably the same plastic material used for the lid 10, and is defined by the rim 39, a side wall 28 extending downward, and a bottom surface 30. As shown in FIG. 3B, and in a preferred embodiment, the diameter "d" of the bottom surface 30 is smaller than the diameter D of the rim 39. The bottom surface 30 of the housing 26 includes a vacuum exhaust or relief hole 41 and a vacuum inlet 43.

The vacuum inlet 43 includes a center hole 27, surrounded by four peripheral holes 29. Both the center hole 27 and peripheral holes 29 extend entirely through the bottom surface 30 of the housing 26. It is within the spirit and scope of the present invention for the vacuum inlet 43 to have fewer, or a greater number of, peripheral holes 29, or to instead surround the center hole 27 with multiple grooves 29' that extend through the bottom 30 (See FIG. 3C). The multiple peripheral holes 29 define an effective diameter 29*d*, and the grooves 29' define an effective diameter 29*d'*.

A vacuum diaphragm 50 (FIG. 1) controls the airflow through the peripheral holes 29 or the peripheral grooves 29'. The vacuum diaphragm 50 includes a dome-shaped cap 52 and a stem 54 extending downward from the dome-shaped cap 52 and a keeper or a flange 56 extending laterally from the stem 54. In a preferred embodiment, the vacuum diaphragm 50 is manufactured from a single piece of rubber, plastic and/or elastomeric material. The stem 54 of the vacuum diaphragm 50 is inserted through the center hole 27 that extends through the bottom surface 30 of the housing 26. The vacuum diaphragm 50 is subjected to pressure differentials that can pull the vacuum diaphragm 50 up and down within the center hole 27. For example, during the evacuation process while a vacuum hose is placed over the vacuum port 22, the air will flow from within the canister body and through the peripheral holes 29 or peripheral grooves 29', contact the underside of the dome-shaped cap 52, travel around the cap 52 and exit the lid through the vacuum port 22. This air flow will push the vacuum diaphragm 50 upward. To prevent the vacuum diaphragm 50 from being lifted completely out of the center hole 27 during the vacuum evacuation process, the stem 54 includes the previously described flange 56 that extends outward from the stem 54. The diameter of the flange 56 is larger than the diameter of the center hole 27 so that the flange 56 operates as a stop. The vacuum diaphragm 50 is urged downwardly when the vacuum hose stops pulling air from the canister body and the ambient pressure becomes greater than the pressure within the canister body. At this point the bottom of the dome-shaped cap 52 contacts the bottom surface 30 of the housing 26. To form an airtight seal between the vacuum diaphragm 50 and the bottom surface 30 of the housing 26, the diameter of the dome-shaped cap 52 is greater than the effective diameter 29*d* or 29*d'* of the holes 29 or grooves 29' so that the cap 52 covers all of the peripheral holes 29 or grooves 29'. By doing so, the vacuum diaphragm 50 will create an airtight seal with the bottom surface 30 of the housing 26 and not allow air to further enter into the canister body. This seal will preserve the vacuum inside the canister body.

A venting valve collar 32 extends upward from the bottom surface 30 and surrounds the vent hole 41 (FIG. 3A). The collar 32 preferably has a circular cross-section. As will be described later, the collar 32 provides support for and guides the venting valve or vacuum release assembly 39 to both maintain an airtight seal and to release the vacuum created within the canister body.

The main components of the vacuum release assembly 39 include the release button 24, an insert pin 34, a valve stem 36, and a spring 38. The shaft 43 of the valve stem 36 and the insert pin 34 are coupled together and form a piston-type mechanism that travels vertically up and down within collar 32 of the housing 26. Specifically, the motion of the valve stem 36 and insert pin 34 is controlled by the up and down movement of the release button 24. The vacuum release button 24 has the plastic insert pin 34 on its bottom to provide improved stiffness to transmit a compression force to the valve stem 36 during vacuum venting.

The valve stem 36 (FIGS. 1, 2) comprises of a shaft 43 having a substantially circular base 37, which has a diameter greater than the shaft 43 so that the base 37 extends outward from the shaft 43 and forms a rim. Positioned over the shaft 43 of the valve stem 36 is an o-ring 44. In a preferred embodiment, the o-ring 44 is slid down over the shaft 43 until the o-ring 44 is flush against the base 37 of the valve stem 36. After the o-ring 44 is placed onto the valve stem 36, the valve stem 36 is coupled to the insert pin 34, and the insert pin 34 engages the release button 24. This vacuum release assembly can slide up and down within the collar 32.

The release or venting valve 36 also includes a spring 38 that provides a sufficient force so that the spring 38 is predisposed to pull the o-ring 44 against the bottom surface 30 of the housing 26, thus forming an airtight seal. The contact area between the o-ring 44 and the housing 26 is very small. To release the vacuum within the canister body, the valve stem 36 is pushed downward to break the seal and contact area between the o-ring 44 and the housing 36. The diameter of the shaft 43 is less than the diameter of the vent hole 41 so that air can flow through vent hole 41. When the seal is broken, air will rush into the cannister through the space between the valve stem 36 and the collar 32.

As shown in FIG. 1, the insert pin 34 and valve stem 36 are predisposed in an uppermost position, such that the o-ring 44 is compressed between the base 37 of the valve stem 36 and the bottom surface 30 of the housing 26. The spring 38 slides over the housing collar 32 and is seated upon a base 33 that extends around the bottom of the collar 32. A washer 40 and e-ring 42 are placed over the valve stem 36 and are located between the spring 38 and insert pin 34. The washer 40 provides a stop for the motion of the spring 38. Generally, it is desirable for the o-ring 44 to form an air tight seal with the bottom surface 30 of the housing 26 and the base 32 of the stem 36 under normal conditions. In order for the insert pin 34 and valve stem 36 to be predisposed in an uppermost position which forms the air tight seal, a force must continually pull the valve stem 36 upward to compress the o-ring 44. Accordingly, the washer 40 is located at a position along the valve stem 36 such that the spring 38 is held in a compressed state. Thus, the spring 38 can always have stored potential energy and create a force pulling the valve stem 36 upward under normal conditions. As the button 24 is pushed down, the spring 36 is compressed between washer 40 and the base 33 of the collar 32. Upon release of the button 24, the spring 36 returns the button 24 to its upper most position and reestablishes a seal with the o-ring 44 held between the base 37 of the stem 36 and the base 30 of the housing 26.

A safety cap 46 is pressed fit onto the housing 26. The cap 46 allows air to be evacuated from the canister body, and vented back into the canister, yet keeps liquid from being drawn into the housing 26. The cap 46 is placed over the housing 26 in order to prevent liquids from entering the vacuum inlet hole 27, the peripheral hole 29 or grooves 29', or the exhaust vent 31 during the venting process. The housing 26 has multiple spacers 47 located near the bottom of the wall 28. In a preferred embodiment, the spacers 47 extend outward from the wall 28 approximately 1–2 mm and have a rounded top surface. The cap 46 fits over and engages the spacers 47 of the housing 26. The cap 46 is press fit over the housing 26 by being in contact with the spacers 47. Since the cap 46 does not contact the wall 28 or the bottom 30, a gap between the cap 46 and the wall 28 of housing 26 allows air to travel from within the canister body, between the cap 46 and the wall 28, into the housing 26, and out the vacuum port 22. The cap 46 allows a person to fill the canister body with more liquid than if the cap 46 were not placed over the housing 26. For example, if the cap 46 was not placed over the housing 26 and liquid was filled to a level above the bottom surface 30 of the housing 26, liquid would be drawn into the housing 26 and thus the vacuum hose, and may cause damage to the vacuum pump. The cap 46 will prevent this from occurring.

Extending downward from the periphery of top surface 12 is an interior collar 18 and an exterior collar 20. In a preferred embodiment, the interior collar 18 and the exterior collar 20 are circular and parallel to each other. The diameter of the interior collar 18 is preferably smaller than the diameter of the opening or rim of the canister body. The diameter of the exterior collar 20 is preferably greater than the diameter of the canister body opening or rim. Accordingly, the diameter of the interior collar 18 is smaller than the diameter of the exterior collar 20.

The interior collar 18 and exterior collar 20 are spaced-apart from each other so that a gasket 58 (described hereinafter) can be inserted into and retained within the gap located between the interior collar 18 and the exterior collar 20. This dual collar configuration is designed so that the rim of the canister body can engage the gasket 58 when the lid 10 is placed on top of the canister body. The interior collar 18 preferably extends further downward from the top surface 12 than the exterior collar 20. The interior collar 18 extends downward far enough so that at least a portion of the interior collar 18 (e.g., distal end 19 of the interior collar 18) is located within the opening of the canister body when the lid 10 is placed on top of, and forms an airtight seal with, the canister body. The exterior collar 20 is located outside of, and surrounds a portion of the canister body opening or rim when the lid 10 is placed on top of, and forms an airtight seal with, the canister body.

The gasket 58 is designed to created a vacuum seal between the lid 10 and the cannister. The gasket includes an engaging portion 60 with preferably three ring-shaped contacts with the cannister. The three contacts include a first surface 66 that is about parallel to the wall of the cannister, a second surface 64 that is at an angle to the third surface 62, and a third surface 62 (FIG. 3D) that is about perpendicular to a wall 70 of the cannister. The second surface 64 is at an obtuse angle to both the first surface 66 and the third surface 62. The first surface continues to the second surface which continues to the third surface. With such an arrangement the gasket has sufficient tolerance so that variations in the gasket and/or the engaging lip of the cannister wall do not interfere with an effective seal between the lid 10 and the cannister. In the embodiment of the cannister shown in FIG. 3A, the wall 70 has an engaging ridge 72 which is urged into the gasket 58 as the lid 10 is fitted to the cannister. The gasket is preferably manufactured from a soft elastic or elastomeric material.

Figure 3C:
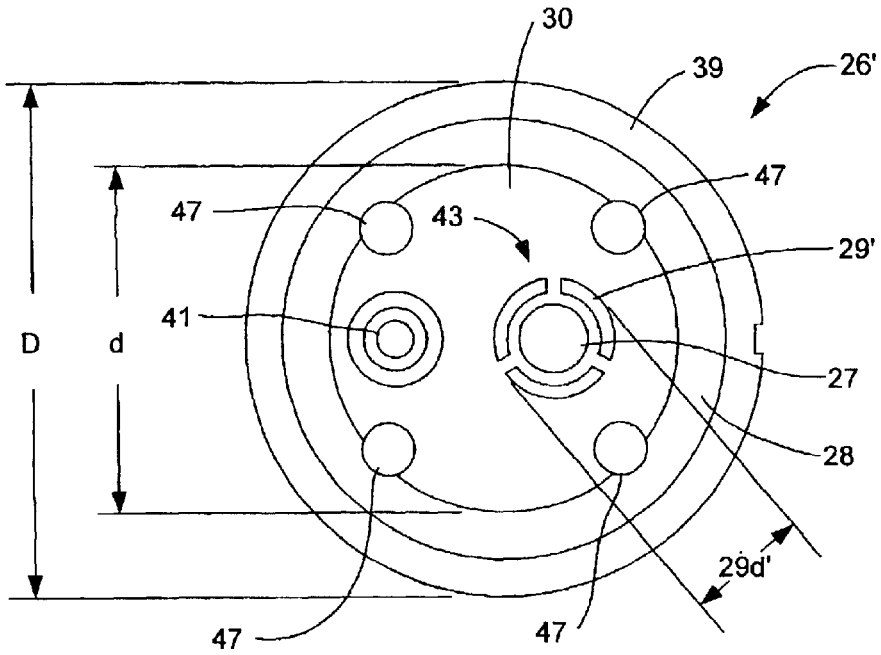
Figure 3D:
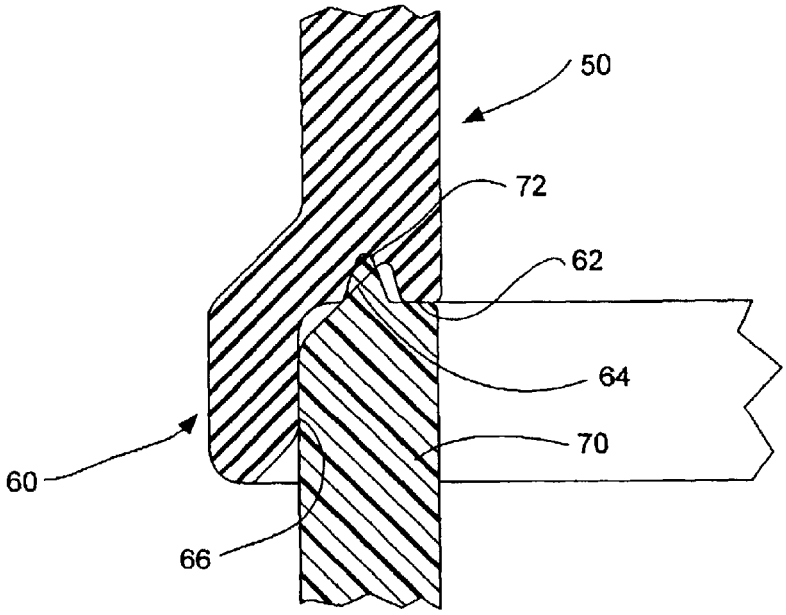

FIG. 3C illustrates an alternative embodiment of the housing 26'. All of the components of the housing 26' that are similar to the previously described housing 26 are described using the same reference numerals. The housing 26' is preferably manufactured from a single piece of material and is defined by a rim 29, a sloped wall 28 extending downward from the rim 29, and a bottom surface 30. Similar to the previously described housing 26, the diameter "d" of the bottom surface 30 is smaller than the diameter "D" of the rim 39. In this embodiment, the vacuum inlet 43 includes a center hole 27 which is surrounded by three peripheral grooves 29' instead of the previously described peripheral holes 29. Even though only three peripheral grooves 29' are shown in FIG. 3C, it is within the spirit and scope of the present invention to have fewer, or a greater number of, peripheral grooves 29'. One advantage of having peripheral grooves 29' instead of peripheral holes 29 includes providing a greater area for the air to travel through during the vacuum process, thus achieving a vacuum within the canister body in a quicker amount of time. Another advantage of the peripheral grooves 29' is that a greater surface area of the vacuum diaphragm 50 will be subjected to the lower pressure within the canister body and thus likely form a better airtight seal with the bottom surface 30 of the housing 26.

In operation, a user may depress the release button 24 to exhaust or vent the vacuum within the canister body. By depressing the release button 24 the valve stem 36 is moved downward, creating a gap between the o-ring 44 and the exhaust vent 31. Accordingly, as the cannister body is vented to the outside, the pressure inside of the cannister is equalized with the ambient pressure.

The foregoing description of the preferred embodiments of the present invention has been provided for the purposes of illustration and description. It is not intended to be exhaustive or to limit the invention to the precise forms disclosed. Many modifications and variations will be apparent to the practitioner skilled in the art. Embodiments were chosen and described in order to best describe the principles of the invention and its practical application, thereby enabling others skilled in the art to understand the invention, the various embodiments and with various modifications that are suited to the particular use contemplated. It is intended that the scope of the invention be defined by the following claims and their equivalents.

We claim:

1. A canister lid adapted for covering a canister which can be evacuated, the canister lid comprising:

a cover member adapted to cover the canister, thereby defining an interior of the canister;

a housing attached to an underside of said cover member, wherein a chamber is defined by an interior of said housing and said underside of said cover member;

a top surface which is dome-shaped with a plateau in said dome-shaped top surface;

a vacuum port that provides an air passageway between said chamber and ambient, said vacuum port adapted to be connected to a source of vacuum, said vacuum port provided through said plateau;

a valve which is adapted to selectively communicate the vacuum port through the chamber to an interior space of the canister;

a venting port which is adapted to cause the interior space of the canister to be connected through the chamber to ambient; and a plunger mechanism including a release button end, a base that extends below the venting port, and a stem that extends between said release button end and said base, said base being biased upward thereby sealing said venting port;

wherein said venting port is adapted to communicate between the interior space of the canister and the vacuum port through the chamber; and wherein when a downward force is applied to said release button end of said plunger mechanism, said stem and said base move downward, thereby causing a gap to form between the venting port and said base, said gap allowing air to enter the interior space of the canister when pressure within the interior of the canister is lower than ambient pressure.

2. The canister lid of claim 1 wherein said valve is a flapper valve.

3. The canister lid of claim 1 including a gasket adapted for sealing the canister lid to a canister; wherein said gasket includes three points of contact between the gasket and the cannister.

4. A canister lid adapted for covering a canister which can be evacuated, the canister lid comprising:

an upper surface;

a chamber including a chamber wall and said chamber defined below said upper surface;

a vacuum port provided through said upper surface and adapted to be connected to a source of vacuum;

a vacuum inlet provided through said chamber wall and adapted to communicate said chamber with an interior of a canister;

a vacuum valve which can selectively open and close said vacuum inlet and which vacuum valve is adapted to selectively communicate the vacuum port to the interior space of the canister;

a venting port provided through said chamber wall and adapted to communicate said chamber with the interior of a canister; and a venting valve that can selectively open and close said venting port, wherein said venting valve extends though said upper surface so that the venting valve can be manually operated from said upper surface.

5. The canister lid of claim 4 wherein said venting port is adapted to communicate an interior of a canister to ambient through said chamber and said vaccuum port.

6. The cannister lid of claim 4 wherein said vaccuum valve is a flapper valve and said venting valve is a plunger valve.

7. The canister lid of claim 4 wherein said upper surface including a dome-shaped top surface.

8. The canister lid of claim 4 wherein said upper surface including a dome-shaped top surface with a plateau provided in said dome-shaped top surface.

9. The cannister lid of claim 8 wherein said dome-shaped top surface has an apex and said plateau is provided at said apex.

10. The canister lid of claim 4 wherein said upper surface includes a dome-shaped top surface with a plateau provided in said dome-shaped top surface and said vacuum port and said venting valve are provided through said plateau.

11. The canister lid of claim 4 including a protective covering over said chamber wall.

12. The canister lid of claim 4 wherein said chamber wall has a side wall and a bottom wall and said vacuum inlet and said venting port are located through said bottom wall; and a protective covering over said chamber, which protective covering covers said bottom wall and at least part of said slide wall with a space provided between said chamber wall and said protective covering.

13. The canister lid of claim 4 including a gasket adapted for sealing the canister lid to a canister; wherein said gasket includes three points of contact between the gasket and the cannister.

14. A canister lid, comprising:

a cover member adapted to cover a canister, thereby defining an interior of the canister;

a housing attached to an underside of said cover member, wherein a chamber is defined by an interior of said housing and said underside of said cover member;

a first opening and a second opening in said cover member, which are adapted to provide access into said chamber through said cover member;

a third opening and a fourth opening in a bottom of said housing, which are adapted to provide access from the interior of the canister into said chamber through said bottom of said housing;

at least one satellite opening, in said bottom of said housing, near said fourth opening;

a flapper valve including a stem portion and a top portion having a flexible periphery that extends beyond said stem portion, said stem fitting into said fourth opening such that said flexible periphery covers each of said at least one satellite opening;

a release button that includes a portion that rests over said first opening; and a venting valve including an upper end that engages an underside of said release button, a base that extends below the third opening, and a stem that extends between said upper end and said base, wherein said base is biased upward thereby sealing said third openings;

wherein when a downward force is applied to said release button said stem and said base move downward, thereby causing a gap to form between the third opening and said venting valve, said gap allowing air to enter the interior of the canister when pressure within the interior of the canister is lower than ambient pressure.

15. The canister of claim 14, wherein said third opening is substantially aligned with said first opening.

16. The canister of claim 14, wherein when a vacuum is pulled through said second opening, said flexible periphery of said flapper valve is lifted away from said bottom of said housing to allow air to be evacuated through said at least one satellite opening, around said flexible periphery, into said chamber, and out through said second opening.

17. The canister of claim 16, wherein said flexible periphery of said flapper valve covers each of said at least one satellite opening after a vacuum is formed in the interior of the canister.

18. The canister of claim 16, wherein said flexible periphery of said flapper valve, covering each of said at least one satellite opening, and said base of said venting valve, sealing said third opening, retains the vacuum formed in the canister.

19. The canister of claim 16, wherein the cover member includes an outer periphery adapted to engage a peripheral edge of a canister.

* * * * *

UNITED STATES PATENT AND TRADEMARK OFFICE

CERTIFICATE OF CORRECTION

PATENT NO. : 6,789,690 B2
DATED : September 14, 2004
INVENTOR(S) : Luther T. Nieh et al.

It is certified that error appears in the above-identified patent and that said Letters Patent is hereby corrected as shown below:

Column 8,
Line 14, delete “including” and insert therefor -- includes --.
Line 63, delete “openings” and insert therefor -- opening --.

Signed and Sealed this

Eighteenth Day of January, 2005

JON W. DUDAS
*Director of the United States Patent and Trademark Office*